United States Patent [19]

Schadow et al.

[11] Patent Number: 4,957,242

[45] Date of Patent: Sep. 18, 1990

[54] FLUID MIXING DEVICE HAVING A CONICAL INLET AND A NONCIRCULAR OUTLET

[75] Inventors: Klaus C. Schadow; Ephraim Gutmark; Kenneth J. Wilson; Robert A. Smith, all of Ridgecrest, Calif.

[73] Assignee: The United States of America as represented by the Secretary of the Navy, Washington, D.C.

[21] Appl. No.: 180,751

[22] Filed: Apr. 12, 1988

[51] Int. Cl.[5] ..... B05B 1/02

[52] U.S. Cl. ..... 239/590; 239/599

[58] Field of Search ..... 239/589, 590, 592, 594, 239/597, 599, 601, 590.5, 596

[56] References Cited

U.S. PATENT DOCUMENTS

| | | | |
|---|---|---|---|
| 359,602 | 3/1887 | Gray | 239/597 X |
| 1,889,201 | 11/1932 | Holveck | 239/597 |
| 2,026,743 | 1/1936 | Kurtz | 239/594 |
| 2,116,863 | 5/1938 | Dinley | 239/594 |
| 2,125,445 | 8/1938 | Holveck | 239/599 |
| 2,353,318 | 7/1944 | Scheller | 239/592 X |
| 2,799,987 | 7/1957 | Chandler | 60/35.6 |
| 2,981,065 | 4/1961 | Sloan | 60/39.72 |
| 2,990,682 | 7/1961 | Mullaney | 60/35.6 |
| 3,129,894 | 4/1964 | Schermerhorn | 239/597 X |
| 3,221,496 | 12/1965 | Haake | 60/35.6 |
| 3,555,824 | 1/1971 | Buse et al. | 60/220 |
| 3,756,511 | 9/1973 | Shinroku et al. | 239/599 X |
| 4,052,846 | 10/1977 | Schadow | 60/251 |
| 4,502,651 | 3/1985 | Jungclaus | 244/53 B |
| 4,519,423 | 5/1985 | Ho et al. | 137/888 |
| 4,539,918 | 9/1985 | Be'er et al. | 110/266 |

*Primary Examiner*—Andres Kashnikow

*Attorney, Agent, or Firm*—Sol Sheinbein; Melvin J. Sliwka

[57] ABSTRACT

The invention is directed to a fluid mixing device in which a jet of first fluid is passed through a nozzle having a conical inlet section and a noncircular, elongated, exit section. The jet of first fluid mixes with a second fluid located downstream of the device. In operation, the intersection of the conical and elongated sections produces axial rotation in the first fluid. Intense, three-dimensional, axial and circumferential vortical structures are created. These structures then interact with the high modes of azimuthal instabilities that are common to the elongated configuration. The jet of first fluid evolves into two secondary jets, generating a double shear layer inside the flow. Highly efficient mixing of the fluids, in both the outside and inside (core) segments of the jet, is achieved within a relatively small mixing space.

15 Claims, 12 Drawing Sheets

FLUID MIXING DEVICE HAVING A CONICAL INLET AND A NONCIRCULAR OUTLET

BACKGROUND OF THE INVENTION

1. Field of the Invention

The invention relates generally to fluid mixing devices. More specifically, the invention relates to means to cause rotational flow of fluid. In still greater particularity, but without limitation thereto, the invention relates to a device that causes axial vortices and azimuthal instabilities in a first fluid to enhance mixing of the first fluid with a second fluid.

2. Description of the Prior Art

The efficient mixing of fluids is crucial for the operation of many devices. Among these devices, for example, are chemical reactors, combustors and lasers.

Large scale mixing or bulk mixing of fluids has been achieved by contacting a jet of one fluid with a second fluid. The flow instabilities existing at the boundary layer of the jet causes an entrainment of the second fluid within the first fluid.

To achieve efficient mixing however, especially when a reaction is involved, consideration must be given not only to large scale mixing, i.e. the integrated amount of mixed components, but also to small scale mixing, i.e. the amount of molecular mixing.

Much research has been done to develop methods for augmenting both large and small scale mixing. Active methods, those utilizing energy from an external source, and passive methods, those utilizing the internal energy of the fluid or fluids being mixed, have been employed depending upon the enviroment in which the mixing is to take place.

A passive method that has been studied uses a small aspect ratio elliptic nozzle. Entrainment into a jet emitted from this elliptic nozzle, compared to a jet emitted from a circular nozzle, was substantial. Large scale mixing was considerably increased, relative to the circular nozzle, due to an induction effect of elliptical vortices created by this nozzle. Small scale mixing was also enhanced, due to high azimuthal instability modes that are amplified by this non-circularly shaped nozzle.

Although the elliptical nozzle does contribute to improved mixing, a variety of applications could benefit from even greater mixing, particularly, small scale mixing. Further, for the elliptic nozzle, the increase in the level of turbulence in the core of the jet is relatively slow in the downstream direction. This is considered a drawback when a high mixing rate is required throughout the flow field. Additionally, there are situations in which mixing space is quite limited, compelling the need for a mixing device that provides efficient mixing in a relatively small space. While the elliptic nozzle has exhibited superior characteristics in this respect, a device that efficiently mixes fluids in an even smaller space would be worthy.

SUMMARY OF THE INVENTION

The invention is directed to a fluid mixing device in which a jet of first fluid passes through a nozzle having a conical inlet section and a noncircular, elongated, exit section. The jet of first fluid mixes with a second fluid located downstream of the device.

In operation, the abrupt intersection of the conical and elongated sections produces axial rotation in the first fluid. Intense, three-dimensional vortical structures are created. These structures interact with the high modes of aximuthal instabilities that are common to the elongated configuration. The jet of first fluid than evolves into two secondary jets, generating a double shear layer inside the flow. Highly efficient mixing of the fluids, in both the outside and inside (core) segments of the jet, is achieved within a relatively small mixing space.

OBJECTS OF THE INVENTION

It is an object of the invention to provide a device for efficiently mixing two or more fluids of the same phase or of different phases.

A further object of the invention to provide a fluid mixing device that causes efficient small scale or molecular mixing of two or more fluids.

A further object of the invention to provide a fluid mixing device that causes efficient large scale or bulk mixing of two or more fluids.

A further object of the invention to provide a fluid mixing device that uniformly mixes two or more fluids.

A further object of the invention to provide a fluid mixing device having a jet of generally uniform downstream mixing characteristics.

A further object of the invention to provide a device that efficiently mixes two or more fluids within a relatively small space.

BRIEF DESCRIPTION OF THE DRAWINGS

Other objects, advantages and novel features of the invention will become apparent from the following detailed description of the invention when considered in conjunction with the accompanying drawings wherein.

DESCRIPTION OF THE PREFERRED EMBODIMENT

Figure 1A:
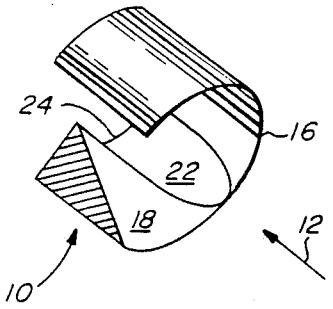
FIG. 1A is an isometric view of a mixing device according to the invention.
Figure 1B:
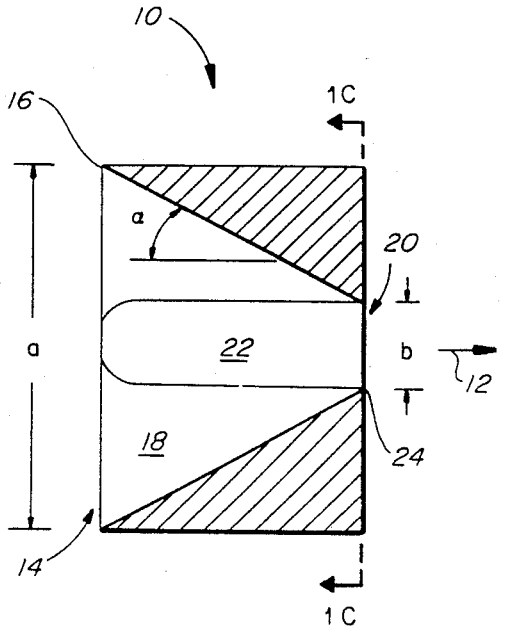
FIG. 1B is a partially sectioned side view of the device shown in FIG. 1A.
Figure 1C:
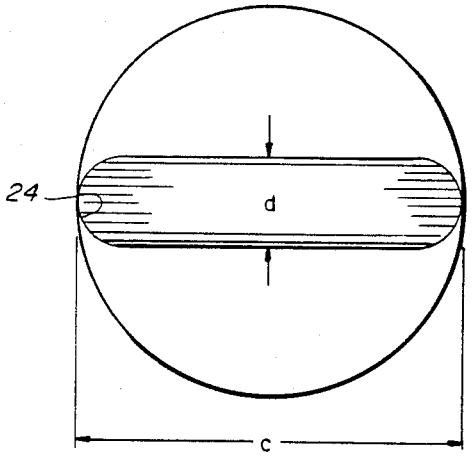
FIG. 1C is an end view of the device of FIG. 1B taken in the direction of 1C—1C illustrating a noncircular orifice of quasi-rectangular shape.

In FIGS. 1A, 1B and 1C, a fluid mixing device 10 of the present invention is shown. A first fluid flows, in a predetermined direction 12, through device 10. Device 10 includes a generally conical section 14 having a large dimension "a" and a small dimension "b". Conical section 14 includes a substantially circular inlet 16 located at dimension "a" and an interior surface 18 extending from inlet 16 and converging towards small dimension "b". A noncircular section 20, also a part of fluid mixing device 10, merges with conical section 14. Noncircular section 20 has an interior surface 22 that abruptly intersects with interior surface 18 of conical section 14. Interior surface 22 is generally parallel to flow direction 12, and terminates in a noncircular exit orifice 24, also a part of noncircular section 20.

Orifice 24 can be seen to be elongated, and has a major axis dimension equal to "c" and a minor axis dimension equal to "d", with the major and minor axis dimensions being unequal and at right angles to each other. In this context, the major axis is the maximum linear dimension of orifice 24, while the minor axis is perpendicular to the major axis, and represents the maximum linear dimension in this direction.

Figure 1D:
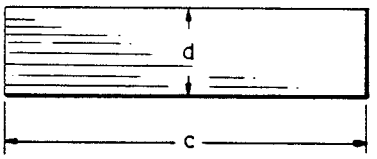
FIG. 1D is a partial end view of an alternative embodiment of the device shown in FIGS. 1A–1C in which the noncircular orifice is rectangular in shape.
Figure 1E:
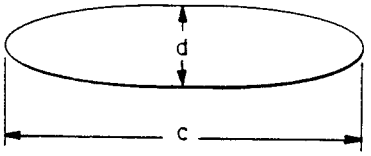
FIG. 1E is a partial end view of an alternative embodiment of the device shown in FIGS. 1A–1C in which the noncircular orifice is elliptical in shape.

Orifice 24 is preferably of a quasi-rectangular shape of low aspect ratio. Applicants believe that an aspect ratio as high as ten-to-one will provide effective results when incorporated in the invention, and have successfully employed aspect ratios ranging from two to five with this quasi-rectangular shape. This preferred shape is best visualized as a rectangle with outwardly facing semicircular ends, the semicircles being of a diameter equal to the width of the rectangle. The quasi-rectangular orifice was chosen because its uncomplicated shape makes it relatively easy to manufacture and less costly to produce, when compared to elongated orifices of other shapes. It was chosen also because its shape closely parallels the elliptical orifice, to which improved mixing characteristics have been attributed. It must be emphasized that applicants believe that any elongated orifice of low aspect ratio, such as the rectangular and elliptical shapes shown respectively in FIGS. 1D and 1E, will give rise to improved fluid mixing if made a part of the invention.

In operation, as discussed above, a first fluid flowing in direction 12 is passed through device 10 to mix with a second fluid 13 located immediately downstream of the device. As the jet of first fluid encounters the abrupt intersection of inner surface 18 of conical section 14 and inner surface 22 of noncircular section 20, three dimensional vortices develop. The jet continues through noncircular section 20 where azimuthal disturbances are introduced into the flow. The flow becomes unstable due to numerous azimuthal modes, leading to an eventual breakdown of the flow into small scale turbulence. At this point a high degree of mixing on the molecular scale takes place. At or about the exit of the nozzle, the jet evolves into two secondary jets, each of which generally are at opposite ends of major axis "c". Turbulence within the core of the jet is augmented by the additional shear layer generated between these two jets.

The mixing of the jet of first fluid with the second fluid takes place immediately downstream of the device. The second fluid could be stationary realtive to the jet, or could be made to flow into the jet as by an injector. Further, the device may include a containment structure (not shown) positioned at or downstream of orifice 24, in which the second fluid could be introduced into the area of the jet. This structure may be of a closed design such as a duct, or of an open design such as a whirlpool bath.

The performance of the mixing device described above was checked by experimentation conducted with a free jet and interchangeable nozzles. For comparison purposes, two nozzle shapes were studied: a three-to-one aspect ratio quasi-rectangular orifice, and three-to-one aspect ratio device according to the invention.

The quasi-rectangular orifice was 2 centimeters (cm) wide and 6 cm long, yielding an equivalent diameter (De) of 3.8 cm. the orifice consisted of a 4 cm long, 2 cm wide rectangle with a 2 cm diameter semicircle outwardly oriented at each of the rectangle's ends.

Referring again FIGS. 1B and 1C, side and end views of the mixing device of the invention are shown, respectively. In the experimental device, major dimenions "a" of conical section 14 was equal to 6 cm, with inlet 16 being of the same diameter. The minor dimension "b" of section 14 was equal to 2 cm. Inner surface 18 of conical section 14 converged towards predetermined flow direction 12 by an angle $\alpha$ "alpha" of 38 degrees. Orifice 24 was quasi-rectangular in shape, as shown, with the major axis dimension "c" being 6 cm and the minor axis dimension "d" equaling 2 cm, thereby yielding an equivalent diameter of 3.8 cm. As is apparent, orifice 24 was a copy of the comparison nozzle described above.

It must be stressed that the above described dimensions are given for purposes of example only, and in no way are intended to limit or otherwise restrict the application or variation of the invention. Even though in the experimental embodiment major axis "c" of orifice 24 was generally equivalent to large dimension "a" of conical section 14, this relationship is by no means intended to be a limitation, for applicants have obtained effective mixing results with minor axis dimensions substantially less than the large dimension of the upstream section. Further, though a contraction angle "alpha" of 38 degrees was used for the experimental embodiment, appicants do not limit their invention to this angle. Experimentation by the applicants has shown that by varying this contraction angle, dramatic alteration in the flow are possible, such as changes in the rate of turbulence augumentation, turbulence distribution and spreading rate in the major and minor axes. Results indicating these changes were achieved with contraction angles of 7.5 degrees up to and including angles of 38 degrees. Applicants believe that contraction angles ranging from 5 to 45 degrees, when incorporated in the invention, will provide improved mixing. Within this range, a contraction angle between approximately 20 to 38 degrees is preferred, with this preferred range believed to be extendable to about 40 degrees. Additionally, an exit orifice with a three-to-one aspect ratio is not a mandatory requirement of the invention, but instead serves only as an example. Applicants have tried other low aspect ratios with success, noting that by varying the ratio from two to five, an increase in the spread of the jet in its minor axis and an increase in the turbulence augumentation of the jet can be realized. Applicants believe that aspect ratios even as large as ten-to-one will give rise to enhanced mixing when incorporated with the device disclosed herein, with aspect ratios of about three to five being within a preferred range.

The experimental device described above was supplied with air from a radial blower. The blower was, in turn, attached to a diffuser by a flexible hose. The air passed from the diffuser to a cubic chamber and then to a main settling chamber further downstream. The main settling chamber was of circular cross section and was 500 millimeters long. This chamber contained a honeycomb and two screens. Ultimately, air of highly uniform flow was produced.

Hot wire anemometers were used to measure flow velocities, turbulence intensities and other flow characteristics. A x-y lathe table was used as a traverse mechanism, controlling the axial and radial positions of the probes. a minicomputer was used to record and convert the anemometer readings.

Figure 2A:
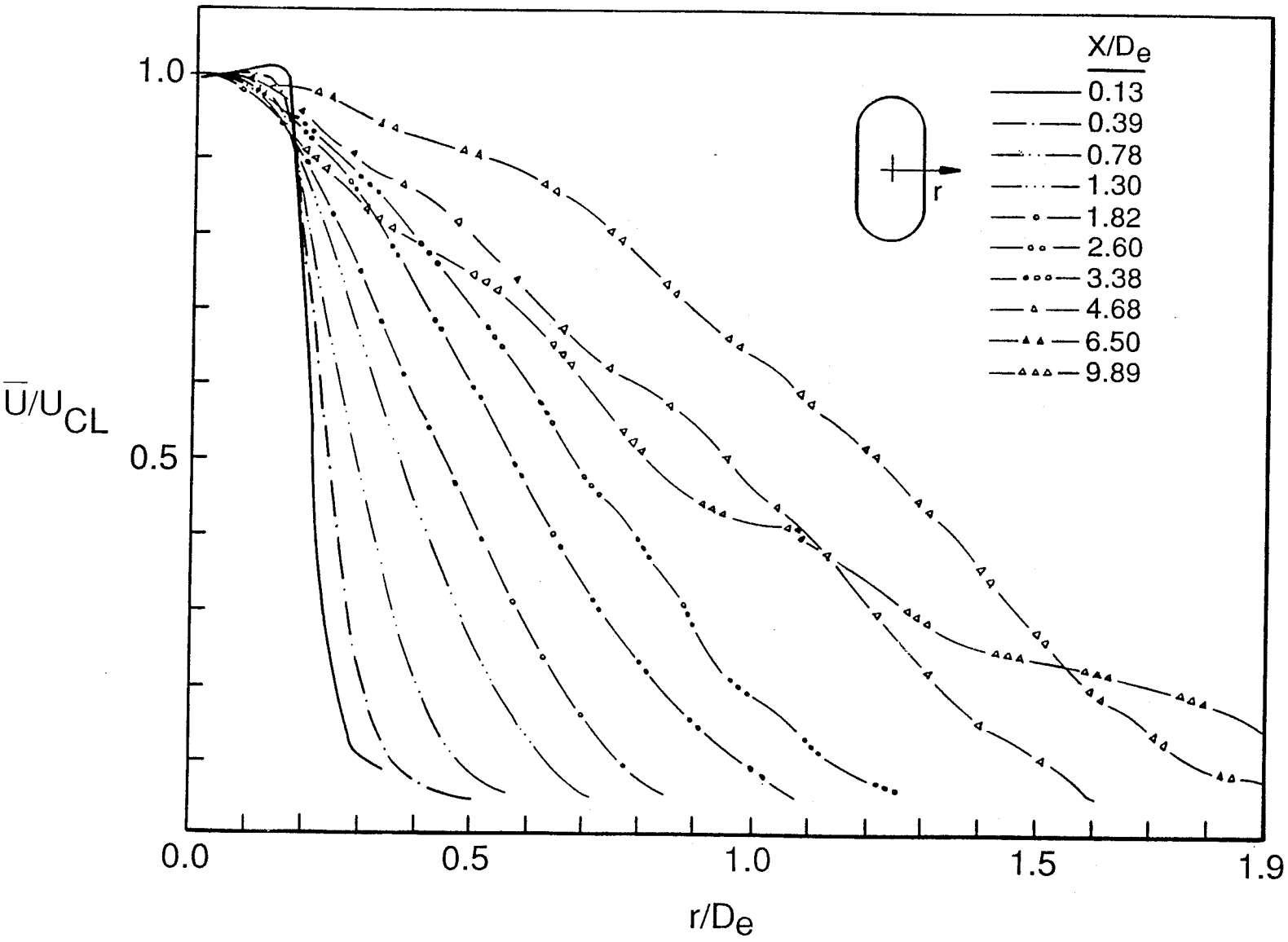
FIGS. 2A and 2B are mean velocity profiles along the minor and major axis planes, respectively, of a jet emitted from a quasi-rectangular orifice.
Figure 2B:
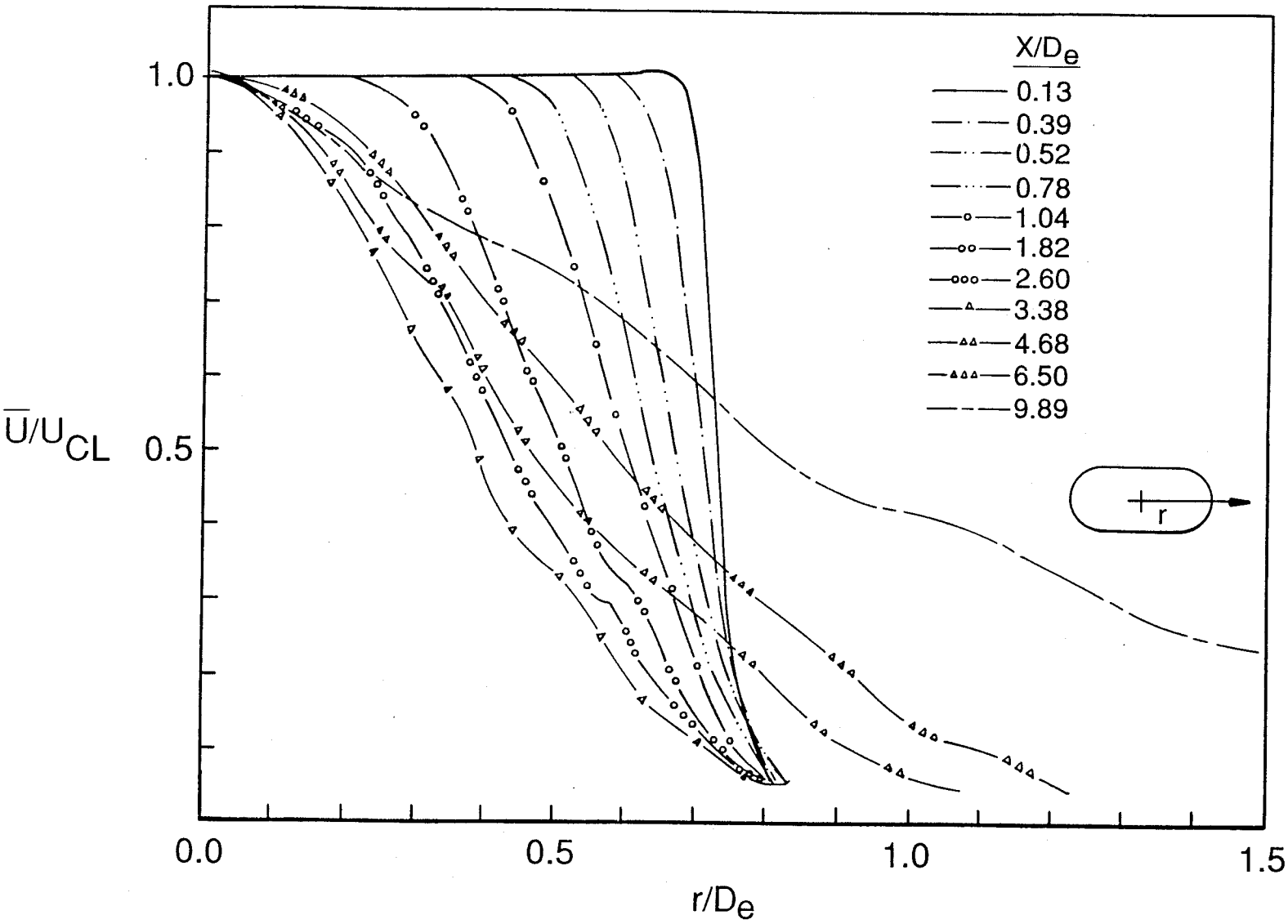

Experimentation began by examining the mean velocity profiles of the quasi-rectangular orifice in its minor and major axis planes. Referring to FIGS. 2A and 2B, the normalized mean axial velocities ($\overline{U}/U_{CL}$, where $\overline{U}$ is the mean axial velocity and $U_{CL}$ is the mean axial velocity at the centerline of the jet) are plotted for the minor and major axis, respectively, with respect to the distance along the axis from the centerline (r) of the orifice over the equivalent diameter (De). These plots were made for varying normalized distances downstream (X/De) of the device. As can be seen from FIG. 2A, the jet spreads along the minor axis from the edge of the orifice (r/De approx. =to 0.25). FIG. 2B shows that along the major axis the jet substantially contracts from the edge of the orifice (r/De approx. =to 0.75).

Figure 3:
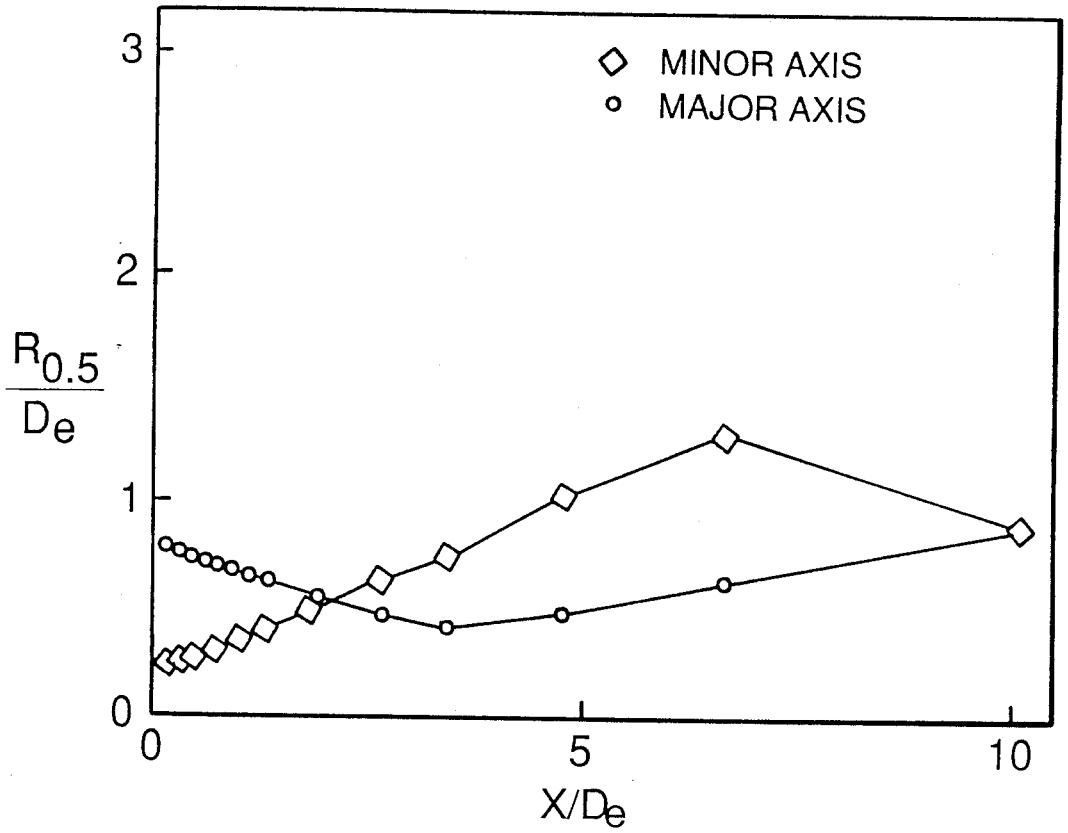
FIG. 3 indicates the spreading rate of the jet emitted from the quasi-rectangular orifice.

A comparison of the half-width variations, or spreading rates, for the two axes of the quasi-rectangular orifice is made in FIG. 3. The half-width or $R_{0.5}$/De represents a normalized measurement of the radial width of the jet at a point where the mean velocity of the jet ($\overline{U}$) is equal to one half of the centerline velocity of the jet ($U_{CL}$). As can be seen, the width in the plane of the minor axis is three times narrower than the major axis in the initial region of the jet, and increases almost linearly to become equal to the jet width in the plane of the major axis at X approximatly=to 2 De. The width of jet in the plane of the major axis decreases from the initial region continuously with X, and beyond X=2 De kthe major axis becomes the monor one and vice versa. The jet resumes its growth on the major axis plane (at X/De=3.5) at a lower rate than the growth on the major axis side. One more switch of axes occurs at X=10 De.

Figure 4A:
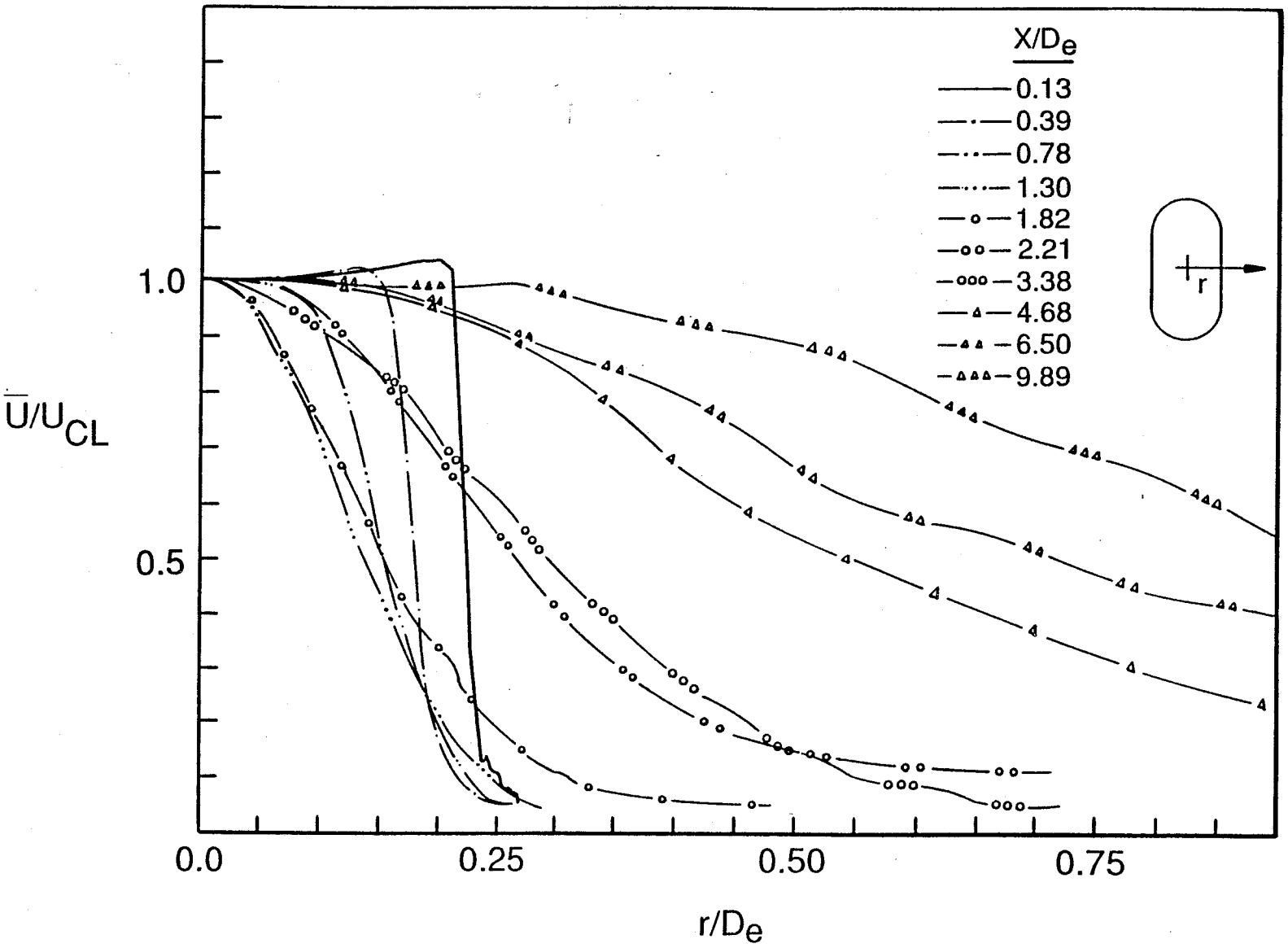
FIGS. 4A and 4B are mean velocity profiles along the minor and major axis planes, respectively, of a jet emitted from the device of the invention.
Figure 4B:
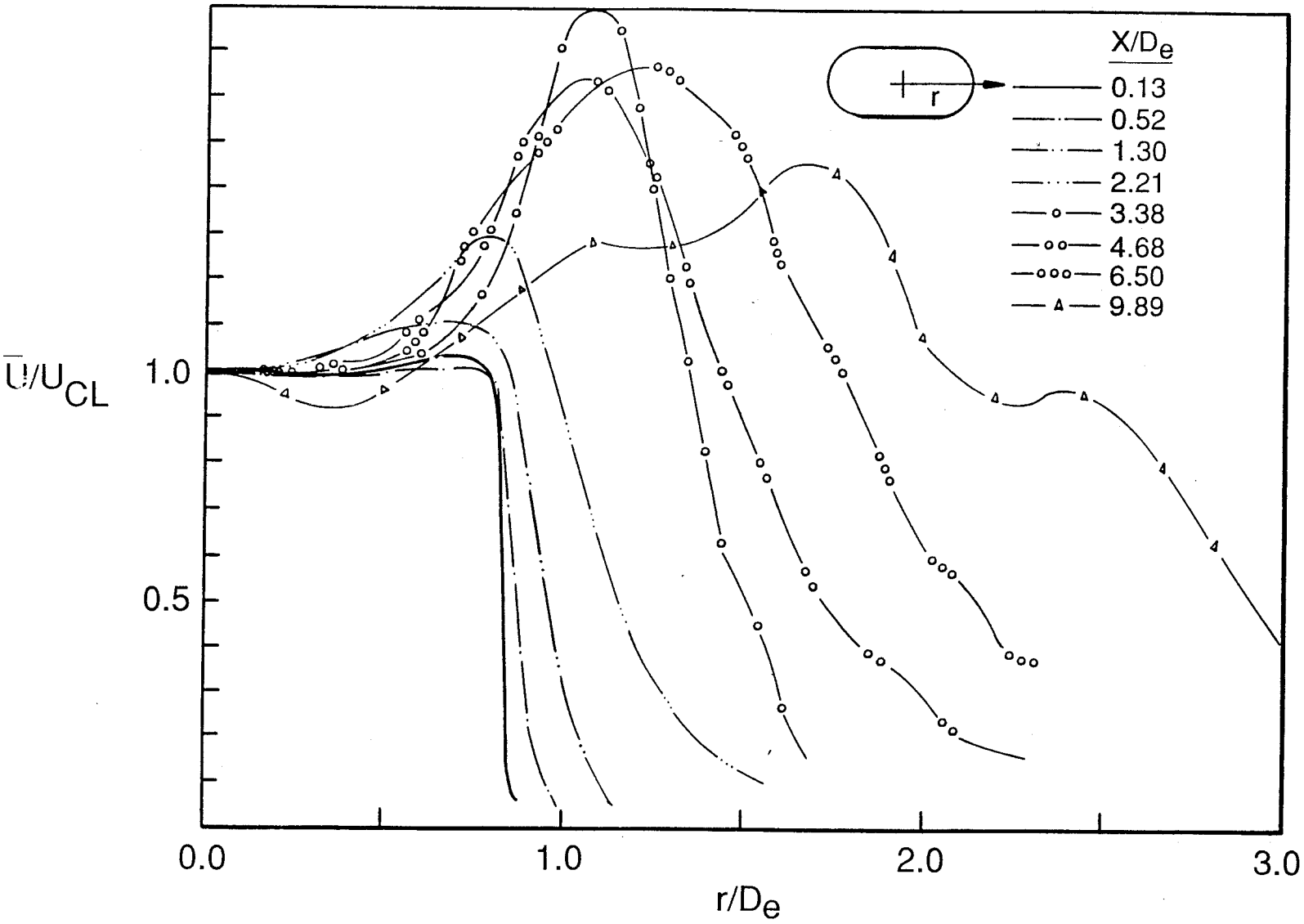

By examining FIGS. 4A and 4B, respectively, and comparing these to FIGS. 2A and 2B, it can be seen that for the mixing device of the invention, the initial mean velocity variation along the minor and major axes is similar to the profiles of the quasi-rectangular orifice. But as can be seen in FIGS. 4A and 4B, a considerable change in the flow behavior takes place at about X/De=1.3. Starting from X/De =1.3, a hump in the plane of the major axis is generated. The mean velocities rise until a maximum velocity is achieved about the edges of the jet. This is contrary to that of a typical jet, which experiences a maximum velocity at its center. The velocity rise occurs only at the major axis section and persists as far as X/De=9.89. These velocity humps, at the jet's edges, result in an additional shear layer between the jet's outer region and its core, see FIG. 4B. The second inflection point created is a new source for turbulence production within the core region of the jet.

Figure 5:
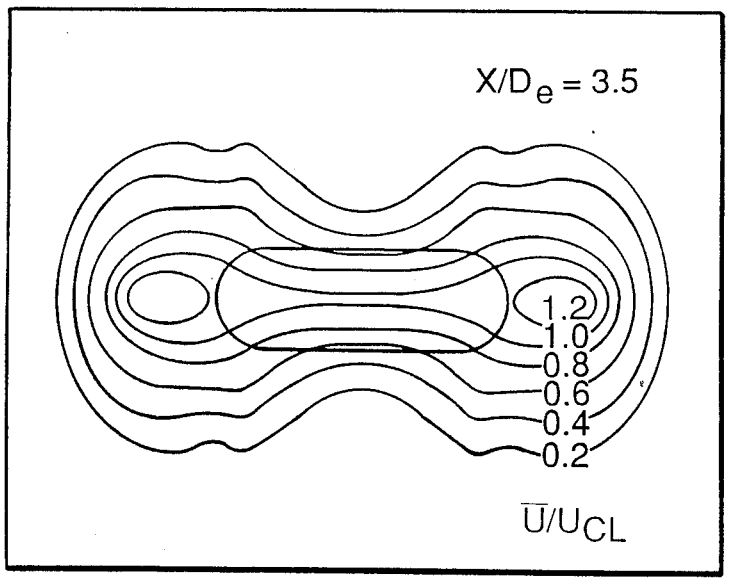
FIG. 5 is a plot of means velocity contours of the jet emitted from the device of the invention at a specified distance downstream of the device.

This special evolution of the jet is perhaps best shown in FIG. 5, which is a plot of isovelocity contours measured at an axial distance of X/De=3.5 from the nozzle of the invention. Here, it can be seen that the jet develops into two secondary jets at the major axis section.

Figure 6:
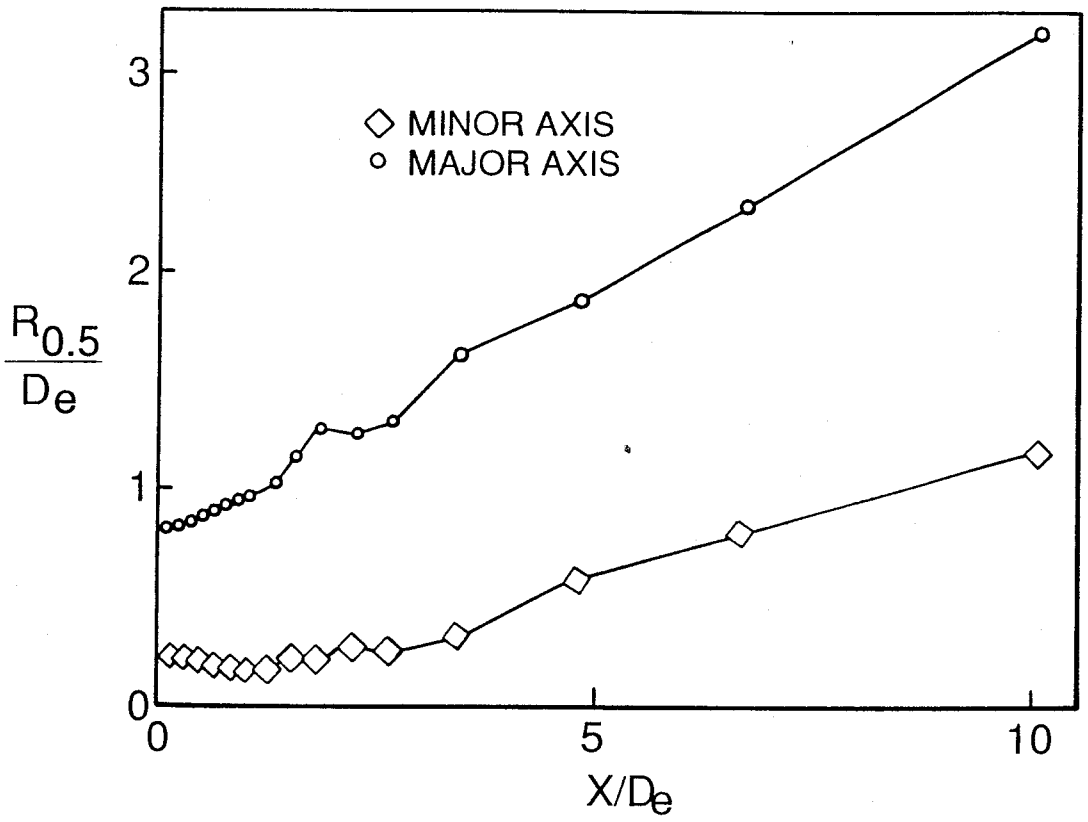
FIG. 6 indicates the spreading rate of the jet emitted from the device of the invention.

Referring to FIGS. 3 and 6, it can be seen that for the mixing device, the spreading rate on the side of the minor axis is reduced in comparison to the quasi-rectangular orifice, while the growth along the major axis is increased substantially. For the mixing device, the spreading rate along the major axis increases even to X/De=10 where the major axis side is nearly three times wider than the minor axis side.

Figure 7A:
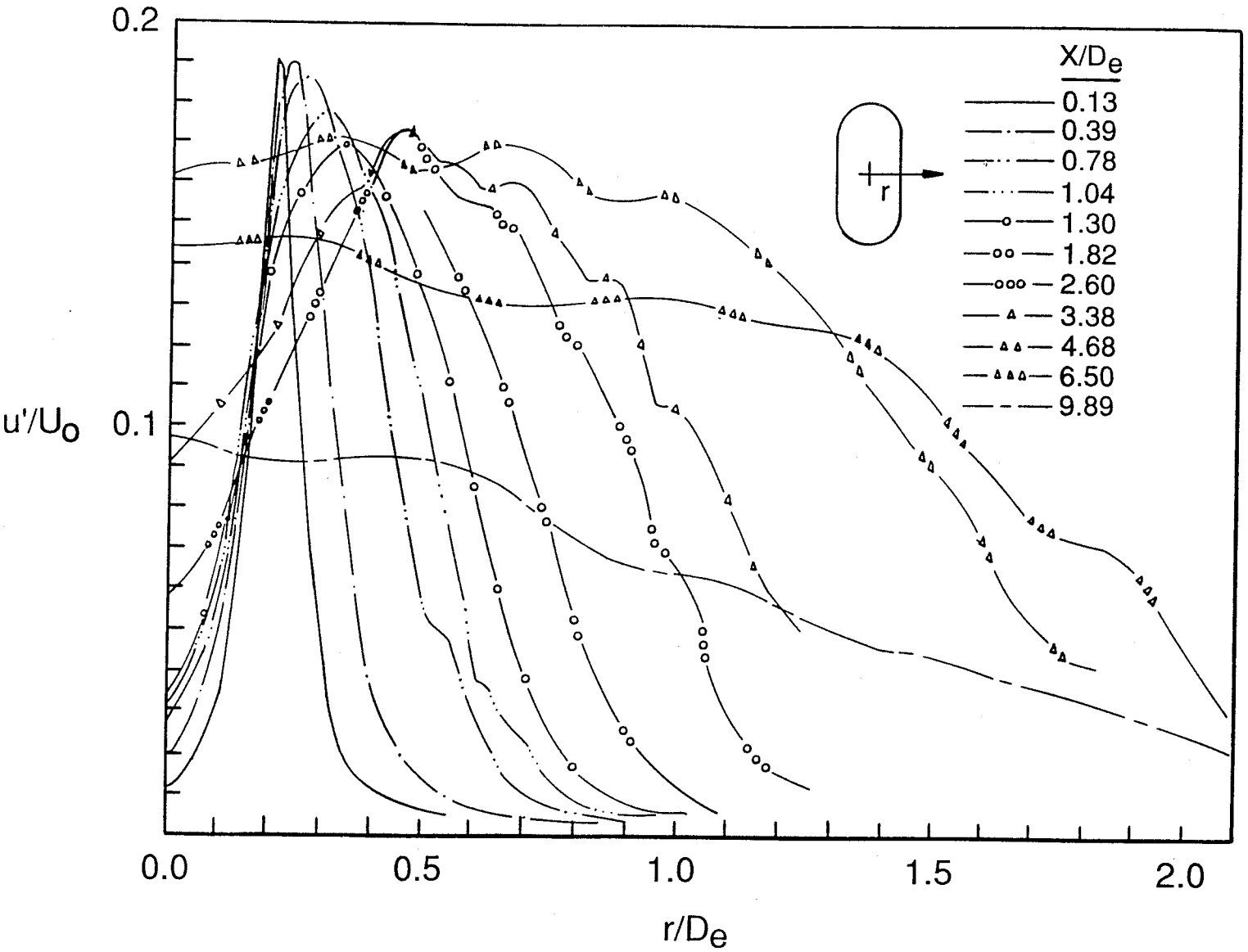
FIGS. 7A and 7B are plots of turbulence intensities along the minor and major axis, respectively, of the jet emitted from the quasi rectangular orifice.
Figure 7B:
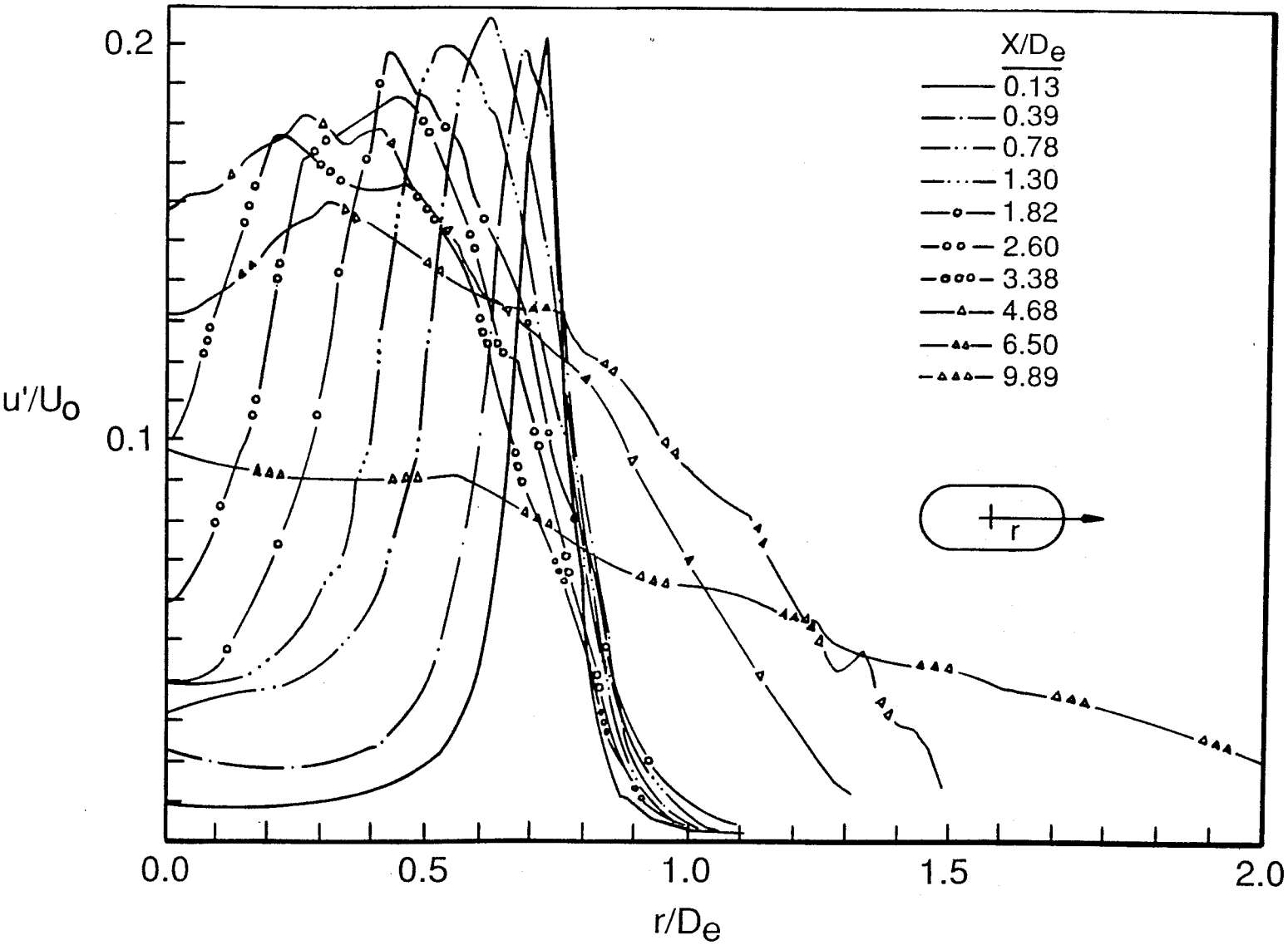
Figure 8A:
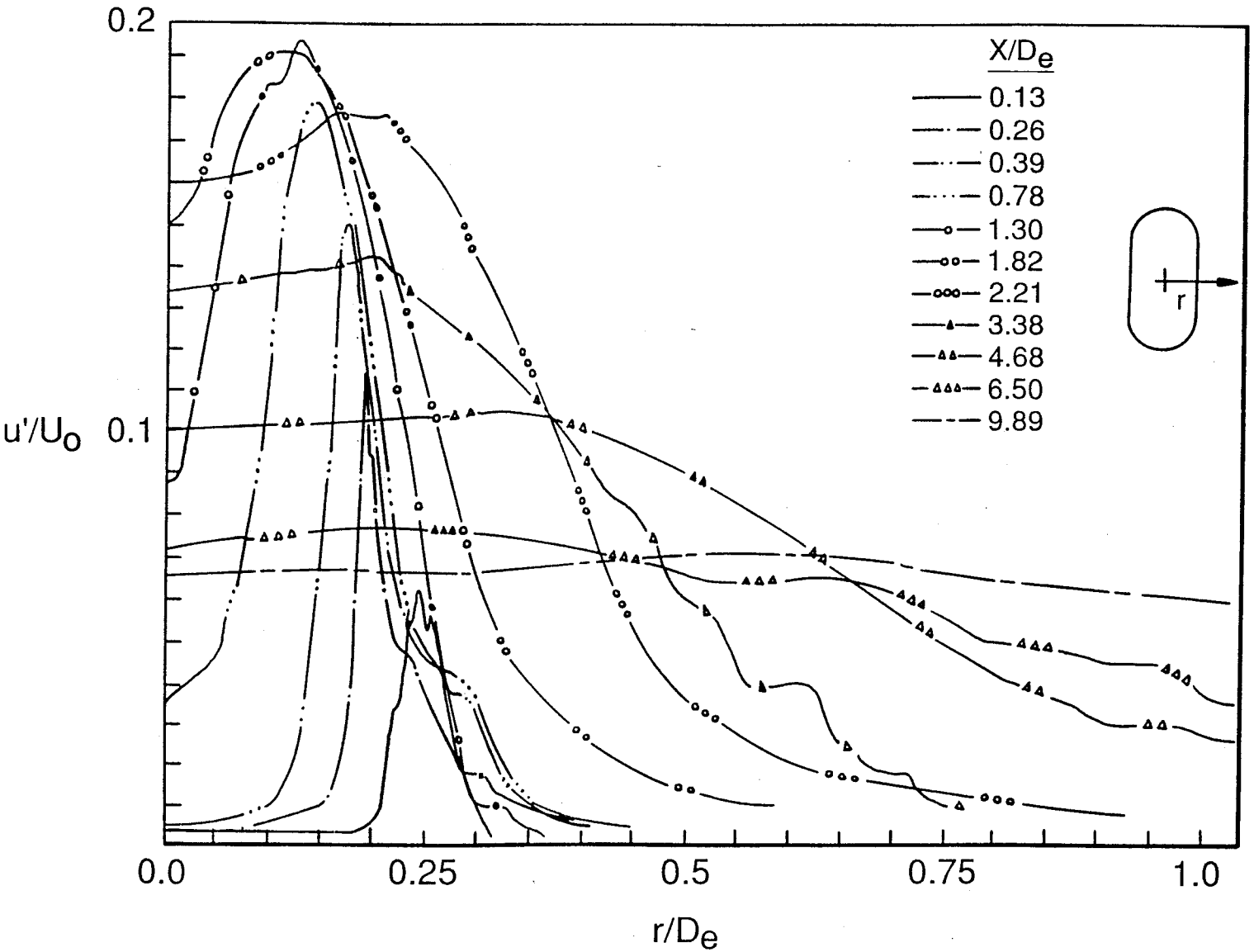
FIGS. 8A and 8B are plots of turbulence intensities along the minor and major axis planes, respectively, of the jet emitted from the device of the invention.
Figure 8B:
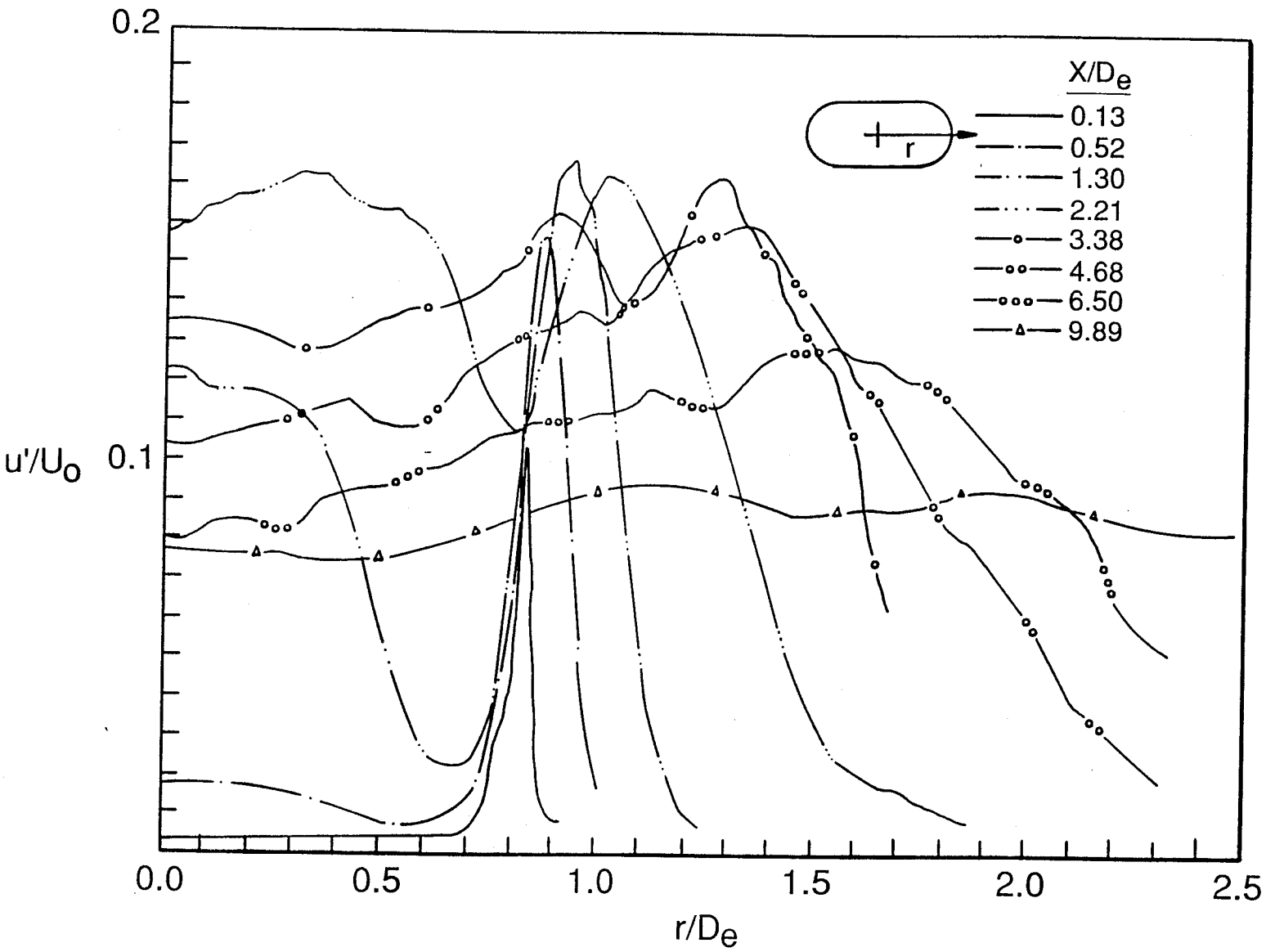

To further assess the significance of the invention's unusual mean velocity distributions, a comparison of the axial component of the turulence intensities for the quasi-rectangular orifice and for the device of the invention was made. Examined first were the turbulence intensity profiles of the quasi-rectangular orifice. These profiles, for the minor and major axis planes respectively, are shown in FIGS. 7A and 7B. The normalized turbulence intensity ($u'$ $U_0$, where $u'$ is the axial turbulence fluctuation equal to the square root of the averaged squared turbulence amplitude ($\sqrt{\overline{u'(t)^2}}$, where $u'(t)=u(t)-\overline{U}$), all of which is normalized by $U_0$, the velocity of the jet at the nozzle) is plotted with respect to the distance along the axis from the centerline (r) of the nozzle over the equivalent diameter (De). These plots were made for varying normalized distances downstream (X/De) of the device. As can be seen, the initial maximum intensity in the shear layer at X/De=1.3 is slightly higher on the major axis compared to the minor axis, and it remains higher further downstream. The increase in the level of turbulence in the core of the jet is relatively slow, and follows a typical axisymmetric jet growth rate. Turning now to the turbulence intensity profiles of the mixing device of the invention. FIG. 8A being of the minor axis plane and FIG. 8B of the major axis plane, it can be seen that the high turbulence activity in the shear layer, i.e. at the jet periphery, is maintained, but in addition, the turbulence in the core of the jet is augmented considerably. This fact is related to the additional shear layer generated in the inner side of the jet and to the initial three dimensional axial and circumferential vortex structure.

Figure 9:
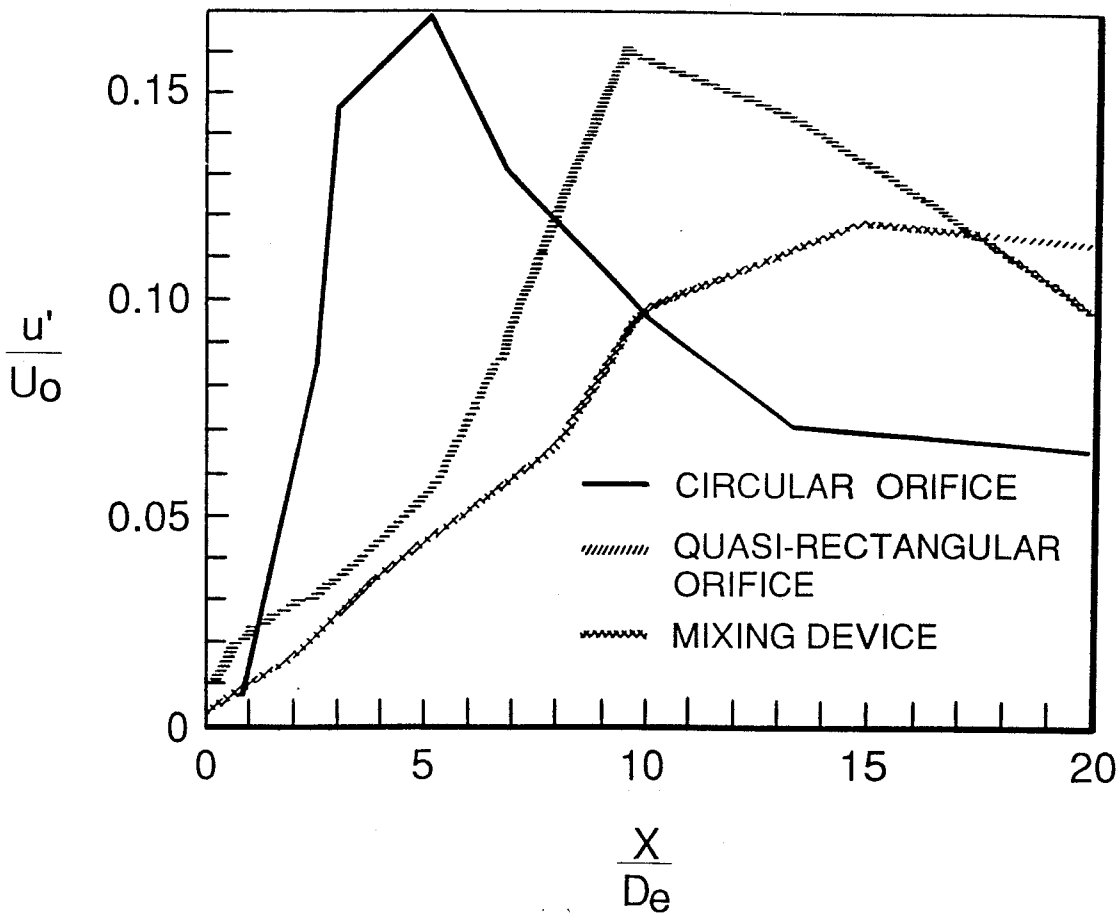
FIG. 9 is a comparison of turbulence intensities along the centerline of jets emitted from circular and quasi-rectangular orifices, and from the invention incorporating a quasi-rectangular orifice.

The variation of turbulence intensities along the axis of a jet emitted from the quasi-rectangular orifice, the mixing device of the invention and a circular orifice are compared in FIG. 9. The turbulence level of the invention increased more rapidly and is more than five times higher in some axial locations than the corresponding quasi-rectangular and circular nozzles.

From the above, it can be seen that a device for the enhanced mixing of two or more fluids has been disclosed. The device has proven to be successful for a wide variety of flow conditions and enviroments. Effective results have been achieved with both free and ducted jets, hot and cold flows, and subsonic as well as supersonic flow rates. It is therefor to be understood that, within the scope of the following claims, the invention may be practiced other than as has been specifically described.

What is claimed is:

1. A fluid mixing device in which a first fluid flows through the device in a predetermined direction and mixes with a second fluid located downstream of the device, the device comprising:

a generally conical section substantially axially aligned with said direction of flow and having a large dimension in substantially a circular orifice through which said first fluid enters, said conical section having an interior surface extending from said circular orifice and converging toward a small dimension of said conical section;

a noncircular section having an interior surface generally parallel to said direction of flow and abruptly intersecting said interior surface of said conical section, said interior surface of said noncircular section extending from said circular orifice and terminating in a noncircular orifice through which said first fluid exits, said noncircular orifice having an elliptical shape, said elliptical shape having a major axis dimension and a minor axis dimension, said dimensions being unequal and at substantially right angle to each other, said major axis dimension being no greater than said large dimension of said conical section and said minor axis dimension being approximately equal to said small dimension of said conical section;

means between said conical section and said noncircular section for generating axial vortices and azimuthal instabilities; and said fluid mixing device having a fixed shape.

2. The device of claim 1 in which:

said interior surface of said conical section converges toward said direction of flow by an angle of at least five (5) degrees and at most forth-five (45) degrees.

3. The device of claim 2 in which:

said major axis dimension is about two (2) to five (5) times said minor axis dimension.

4. The device of claim 1 in which:

said noncircular orifice is generally the shape of a rectangle having outwardly oriented, semicircular ends.

5. The device of claim 1 in which:

said nonicrcular orifice is generally the shape of a rectangle.

6. The device of claim 1 in which:

said noncircular orifice is generally in the shape of an ellipse.

7. The device of claim 1 in which:

said means for generating axial vortices and azimuthal instabilities is the abrupt intersection between the inner surface of said conical section and the inner section of said noncircular section.

8. A fluid mixing device in which a first fluid flows through the device in a predetermined direction and mixes with a second fluid located downstream of the device, the device comprising:

a generally conical section substantially axially aligned with said direction of flow and having a large dimension in substantially a circular orifice through which said first fluid enters, said conical section having an interior surface extending from said circular orifice and converging toward a small dimension of said conical section by an angle from said direction of flow of at least five (5) degrees and at most forty-five (45) degrees;

a noncircular section having an interior surface generally parallel to said direction of flow and abruptly intersecting said interior surface of said conical section, said interior surface of said noncircular section extending from said circular orifice and terminating in a noncircular orifice through which said first fluid exits, said noncirular orifice having an elliptical shape, said elliptical shape having a major axis dimension and a minor axis dimension, said major axis dimension being no greater than said large dimension of said conical section and said minor axis dimension being approximately equal to said small dimension of said conical section, said major axis dimension being less than approximately five (5) times said minor axis dimension and being at substantially a right angle to said minor axis dimension;

means between said conical section and said noncircular section for generating axial vortices and azimuthal instabilties; and said fluid mixing device having a nonelastic shape.

9. The device of claim 8 in which:

said interior surface of said conical section converges toward said direction of flow by an angle of about twenty (20) degrees to about forty (40) degrees.

10. The device of claim 9, in which:

said major axis dimension is about three (3) to five (5) times said minor axis dimension.

11. The device of claim 10 in which:

said noncircular orifice is generally in the shape of an ellipse.

12. The device of claim 10 in which:

said noncircular orifice is generally the shape of a rectangle.

13. The device of claim 10 in which:

said noncircular orifice is generally the shape of a rectangle having outwardly oriented, semicircular ends.

14. The device of claim 10 in which: said large dimension of said conical section is approximately equal to said major axis dimension.

15. The device of claim 8 in which:

said means for generating axial vortices and azimuthal instabilities is the abrupt intersection between the inner surface of said conical section and the inner section of said noncircular section.

* * * * *